US006478830B2

(12) United States Patent
Allison et al.

(10) Patent No.: US 6,478,830 B2
(45) Date of Patent: Nov. 12, 2002

(54) TRANSPARENT COMPOSITIONS AND CANDLES AND METHODS FOR MAKING THE SAME

(75) Inventors: Gerald Allison, Hiawatha, NJ (US); Gilbert Virtucio, Clark, NJ (US)

(73) Assignee: Noville, Inc., South Hackensack, NJ (US)

( * ) Notice: Subject to any disclaimer, the term of this patent is extended or adjusted under 35 U.S.C. 154(b) by 41 days.

(21) Appl. No.: 09/736,448

(22) Filed: Dec. 15, 2000

(65) Prior Publication Data

US 2002/0116867 A1 Aug. 29, 2002

Related U.S. Application Data

(60) Provisional application No. 60/248,199, filed on Nov. 15, 2000.

(51) Int. Cl.[7] ..... C11C 5/00; C10L 5/00

(52) U.S. Cl. ..... 44/275; 44/265; 431/288; 431/289; 431/291

(58) Field of Search ..... 44/275, 265; 431/288, 431/289, 291

(56) References Cited

U.S. PATENT DOCUMENTS

| | | | | |
|---|---|---|---|---|
| 1,950,814 | A | 3/1934 | Pungs et al. | 44/278 |
| 2,831,330 | A | 4/1958 | Walker | 44/275 |
| 3,148,125 | A | 9/1964 | Sabbat et al. | 167/85 |
| 3,341,465 | A | 9/1967 | Kaufman et al. | 252/316 |
| 3,411,855 | A | 11/1968 | Olund | 44/275 |
| 3,563,767 | A | 2/1971 | Wasserman et al. | 44/270 |
| 3,615,289 | A | 10/1971 | Felton | 44/275 |
| 3,630,697 | A | 12/1971 | Duling | 44/275 |
| 3,645,705 | A | 2/1972 | Miller et al. | 44/275 |
| 3,741,711 | A | 6/1973 | Bryant | |
| 3,819,342 | A | 6/1974 | Gunderman et al. | 44/275 |
| 3,844,706 | A | 10/1974 | Tsaras | 44/275 |
| 4,110,261 | A | 8/1978 | Newland | 44/275 |
| 4,275,054 | A | 6/1981 | Sebag et al. | 44/275 |
| 4,332,548 | A | 6/1982 | Linton et al. | 44/275 |
| 4,855,098 | A | 8/1989 | Taylor | 44/275 |
| 5,221,534 | A | 6/1993 | Deslauriers et al. | |
| 5,429,816 | A | 7/1995 | Hofrichter et al. | |
| 5,500,209 | A | 3/1996 | Ross et al. | 424/66 |
| 5,512,648 | A | 4/1996 | Sparrow et al. | 625/307.3 |
| 5,522,136 | A | 6/1996 | Motley | 424/68 |
| 5,578,089 | A | 11/1996 | Elsamaloty | 44/275 |
| 5,603,925 | A | 2/1997 | Ross et al. | 424/65 |
| 5,653,970 | A | 8/1997 | Vermeer | 424/70.25 |
| 5,843,194 | A | 12/1998 | Spaulding | 44/275 |
| 5,871,553 | A | 2/1999 | Spaulding | 44/275 |
| 5,879,694 | A | 3/1999 | Morrison et al. | 424/405 |
| 5,882,363 | A | 3/1999 | Spaulding et al. | 44/275 |
| 5,964,905 | A | 10/1999 | Camp et al. | 44/275 |
| 6,054,517 | A | 4/2000 | Spaulding et al. | 524/275 |
| 6,066,329 | A | 5/2000 | Morrison et al. | 424/405 |
| 6,111,055 | A | 8/2000 | Berger et al. | 528/310 |

FOREIGN PATENT DOCUMENTS

| | | | |
|---|---|---|---|
| WO | WO88/00604 | 1/1988 | |
| WO | WO 97/08282 | 3/1997 | C11C/5/00 |
| WO | WO97/36573 | 10/1997 | A61K/7/48 |

OTHER PUBLICATIONS

Rory Scriven, et al.: *(E,Z)–2,6–Nonadien–1–AL and (E)–2–Nonen–1–Al Present in Crushed Cucumbers are Natural Repellents for the American Cockroach* (Periplaneta Americana), Ohio J. Sci., vol. 84, No. 3, pp. 82–85 Jun. 1984.

Amoco Brochure: *Panalane Hydrogenated Polybutene—The Versatile Cosmetic Base Oil* 1992.

*Primary Examiner*—Jaqueline V. Howard
(74) *Attorney, Agent, or Firm*—Kenyon & Kenyon

(57) ABSTRACT

The present invention relates to transparent compositions that may be used as a base material of transparent candles, to the transparent candles made therefrom, and to methods of making such compositions and candles. The compositions of the present invention include a liquid base material; at least one copolymer that includes at least one diblock, triblock, radial block and/or multiblock copolymer or combination thereof; and at least one derivative of an N-acyl amino acid. Preferably the at least one copolymer is a triblock copolymer and the derivative of an N-acyl amino acid is N-lauroyl-glutamic acid di-n-butylamide. The candles of the present invention may be formed into free-standing candles or container candles. The compositions and candles of the present invention may optionally further include one or more of the following: fragrances, coloring agents, decorative materials, insect repellants, solvents, stablilizers, antioxidants, and/or UV blockers.

44 Claims, No Drawings

TRANSPARENT COMPOSITIONS AND CANDLES AND METHODS FOR MAKING THE SAME

RELATED APPLICATION

This application claims the benefit of U.S. Provisional Application No. 60/248,199 filed Nov. 15, 2000.

BACKGROUND OF THE INVENTION

1. Field of the Invention

The present invention relates to transparent compositions that may be used as a base material for transparent candles, transparent candles, and methods of making such transparent compositions and candles.

2. Description of Related Art

Burning a candle involves a process that imposes rather stringent requirements upon the candle body material in order to be able to maintain a flame, avoid surface pool ignition, and prevent excessive dripping or the candle body melting. When a candle is burned, the heat of the candle's flame melts a small pool of the candle body material around the base of the exposed portion of the wick. This molten material is then drawn up through and along the wick by capillary action to fuel the flame. In order to meet the stringent requirements that the candle's body material must possess, the candle should liquefy at or below temperatures to which the candle's material can be raised by radiant heat from the candle flame. If too high a temperature is required to melt the body material, the flame will be starved because insufficient fuel will be drawn up through the wick, resulting in the flame being too small to maintain itself. On the other hand, if the candle's melting temperature is too low, the candle will drip or, in an extreme case, the entire candle body will melt, dropping the wick into a pool of molten body material, with the potential that the surface of the pool could ignite.

Additionally, in order to meet the stringent requirements upon the candle body material, when molten, the material should have a relatively low viscosity to ensure that the molten material will be capable of being drawn up through the wick by capillary action.

Additional desired features may place still further demands on these already stringent requirements. For example, it is generally desirable that the candle body material burn with a flame that is both luminous and smokeless, and that the odors produced by its combustion should not be unpleasant. These features require that the composition used to made such candles meet even further physical requirements. Additionally, when transparent candles are desired, additional physical requirements must be met by the composition used to make such candles.

Compositions that are presently known for making transparent candles typically have one or more undesirable characteristics. In particular, such compositions typically do not have enough rigidity to form a self-supporting candle, and require some type of container or external support. Such container candles generally additionally possess undesirable characteristics such as the potential for the gel compositions from which they are made shifting, for example, during shipping.

Compositions for making transparent candles also typically have an undesirable gelatinous or oily feeling. In addition, such compositions may darken or smoke during burning, which is aesthetically undesirable. Candles made from transparent compositions may also exhibit undesired external cracking and/or internal fractures.

For example, U.S. Pat. Nos. 5,578,089 and 5,879,694 describe making candles from transparent base materials that result in one or more undesirable qualities. U.S. Pat. No. 5,578,089 describes a heterophase thermally reversible mineral oil formed by a system of physically crosslinked block copolymers. The thermoplastic rubber type polymers of U.S. Pat. No. 5,578,089 consist of block segments of styrene monomer units and rubber monomer units, wherein each block segment may consist of 100 monomer units or more. Such styrene/rubber-based candle compositions are disadvantageous because they are susceptible to surface ignition, which may produce black smoke, and also have limited fragrance throw.

U.S. Pat. No. 5,879,694 discloses a composition which may be used as a candle. Compositions included within the '694 disclosure may be subject to slumping under certain conditions.

SUMMARY OF THE INVENTION

It is an object of the invention to provide a transparent composition for use as a base material for transparent candles which does not suffer from the preceding shortcomings and drawbacks of the prior art.

These and other objects of the invention are achieved by a transparent composition, which includes a liquid base material; at least one copolymer of a thermoplastic rubber selected from the group consisting of diblock, triblock, radial block, and/or multiblock copolymers; and at least one derivative of an N-acyl amino acid. The present invention is also directed to transparent candles made from such transparent compositions and at least one wick. The present invention is further directed to a method for making the transparent compositions and transparent candles disclosed herein. The compositions and candles of the present invention do not exhibit the undesired qualities of previously described transparent compositions and candles.

In a preferred embodiment, the compositions of the present invention have advantageous properties such as greater tensile strength when used as candles than previously described compositions for making candles. Compositions according to this embodiment preferably include 0.1–2 weight percent of the derivative of an N-acyl amino acid. Additionally, due to the greater tensile strength of compositions according to this embodiment as compared to prior compositions, such compositions may be optionally formed into transparent pillar candles.

In another preferred embodiment, the compositions of the present invention preferably include 0.05–1 weight percent of the derivative of an N-acyl amino acid. Compositions according to this embodiment may be optionally formed into container candles. Transparent container candles formed from the compositions of the present invention, unlike previously described transparent container candles, advantageously do not shift, for example during shipping.

In preferred embodiments of the transparent compositions, the liquid base material is a hydrocarbon oil, the at least one copolymer is a triblock copolymer, more preferably Kraton® G1650, and the at least one derivative of an N-acyl amino acid is N-lauroyl-glutamic acid di-n-butlyamide.

The compositions of the present invention may optionally include one or more additional components to produce candles having enhanced or additional aesthetic and/or functional improvements. In particular, the additional materials that may be included in the compositions include fragrances, coloring agents, decorative materials, insect repellants, solvents, stabilizers, antioxidants, and UV blockers.

Preferably, transparent candles formed from the transparent compositions described herein, are self-supporting, and thus, do not require a container or external support.

The transparent candles of the present invention also preferably have other desirable aesthetic features, such as a waxy feel.

A preferred method of making transparent compositions according to the present invention includes 1) adding a liquid base material, at least one copolymer of a thermoplastic rubber, and at least one derivative of an N-acyl amino acid to a mixing vessel and 2) heating the liquid base material to a temperature sufficient to solubilize the at least one copolymer and at least one derivative of an N-acyl amino acid so as to form a transparent composition. The composition may optionally be cooled.

A preferred method of making transparent candles according to the present invention includes 1) adding a liquid base material, at least one copolymer of a thermoplastic rubber, and at least one derivative of an N-acyl amino acid to a mixing vessel; 2) heating the liquid base material to a temperature sufficient to solubilize the at least one copolymer and at least one derivative of an N-acyl amino acid; 3) cooling the mixture to about 250° F.; 4) pouring the transparent composition into a mold or into a container (depending on whether a free-standing or container candle is being made); 5) adding a wick; and 6) cooling the composition. In embodiments where a free-standing candle is being made, the method includes pouring the transparent composition into a mold (rather than a container) and after the composition has cooled, removing the mold. In embodiments where a container candle is being made, the method includes pouring the transparent composition into the container, which will hold the candle after the composition has cooled.

Further objects and advantages of the subject invention will be apparent to those skilled in the art from the detailed description of the disclosed invention.

DETAILED DESCRIPTION OF THE INVENTION

The present invention will now be described in detail, it being understood that the embodiments described herein are intended as illustrative and the invention is not intended to be limited thereto.

The present invention provides compositions from which transparent candles may be made, transparent candles made from such compositions, and methods of making such compositions and candles.

The term "transparent" is used herein to connote a substantial absence of cloudiness or obscurity, so that the body of a candle made of a "transparent" composition features an ability to let light pass through in a substantially unobstructed manner, and an ability to have coloring agent added to the composition without causing cloudiness or reducing the candle's ability to let light pass through in a relatively unobstructed manner. Decorative materials may be among the optional additives to the compositions and candles of the present invention, which those skilled in the art would recognize as potentially obstructing light from passing through certain portions of the compositions and candles. However, such candles would nevertheless be included among those described as "transparent" herein, if the portions of the candle or composition that do not contain such decorative materials would be otherwise considered transparent. Preferably, transparent compositions of the present invention have a degree of clarity, which is most preferably comparable to window glass, transparent glassware, or water. However, the term "transparent" as used herein is not intended to be limited to such clear compositions or candles.

One embodiment of the present invention includes transparent compositions that include a liquid base material; at least one copolymer of a thermoplastic rubber selected from the group consisting of diblock, triblock, radial block, and/or multiblock copolymers ("copolymers"); and at least one derivative of an N-acyl amino acid. The transparent compositions of the present invention are formed from transparent and odorless liquid base materials, copolymers, and derivatives of N-acyl-amino acid As used herein, the term "composition" refers to a transparent base material from which transparent candles may be made. Preferably candles made from such compositions have an aesthetically attractive appearance and can burn safely and cleanly, without cracking or fracturing. The compositions of the present invention can be used to make free-standing candles or container candles that have an aesthetically attractive appearance, depending on the kind and amount of the required ingredients. Based on the present description, those skilled in the art should be able to select and modify the amounts of the required ingredients in order to obtain the desired characteristics.

As used herein, the term "liquid base material" includes all liquids within the composition of the present invention, where the term "liquid" refers to materials which are liquids under ambient conditions. The liquid base material of the present invention is preferably of a type and present in a sufficient amount in the present compositions to solubilize the at least one copolymer and at least one derivative of an N-acyl amino acid, when heated. The liquid base material is preferably compatible with the at least one copolymer and at least one derivative of N-acyl amino acid so that 1) when they are mixed the mixture remains homogeneous and does not phase separate during manufacturing and 2) the finished product remains homogeneous and does not phase separate at ambient conditions over the normal shelf-life which may be upwards of one year. Furthermore, liquid base materials that may be suitable for use in the present invention are preferably selected to provide aesthetic benefits, such as transparency and low tack.

The liquid base material of the present invention comprises a hydrocarbon oil. Examples of hydrocarbon oils that can be used in the present invention include, but are not limited to, one or more of the following oils: colorless mineral oils; refined, aromatic-free paraffinic and naphthenic oils; isoparaffinic oils; and the like. Other suitable oils would be known to those skilled in the art based on the description of the preferred qualities of the liquid base material described herein.

The liquid base material of the present invention is preferably a non-volatile, non-polar, hydrocarbon oil. The term "non-volatile" as used herein refers to materials which exhibit a vapor pressure of no more than about 0.2 mm Hg at 25° C. at one atmosphere and/or to materials which have a boiling point at one atmosphere greater than 230° C.

The liquid base material in the compositions of the present invention, is present in an amount of about 65% to about 95% by weight of the composition. Within this range, the preferred amount varies depending on whether the composition will be used to form a free standing candle or a container candle. For forming a free standing candle, preferably the liquid base material is present in the composition an amount of about 79% to about 91% by weight, and even more preferably about 80% to about 85% by weight.

For forming a container candle, preferably the liquid base material is present in the composition an amount of about 79% to about 95% by weight, and even more preferably about 90% to about 95% by weight.

The at least one copolymer of a thermoplastic rubber (also referred to herein as "at least one copolymer" or "copolymer") of the present invention includes at least one diblock, triblock, radial block, and/or multiblock copolymer, and mixtures thereof.

Examples of preferred copolymers that may be useful in forming the compositions of the present invention are commercially available thermoplastic rubber type polymers. Non-limiting examples of thermoplastic rubber type polymers that may be used in accordance the present invention are sold under the trademark Kraton® by Shell Chemical Company.

Kraton® polymers are elastomers which have an unusual combination of high strength and low viscosity and a unique molecular structure of linear diblock, triblock, and radial copolymers. Each molecule of the Kraton® rubber is said to consist of block segments of styrene monomer units and rubber monomer and/or comonomer units. Each block segment may consist of 100 or more monomer or comonomer units. The most common structure is the linear ABA block type; styrene-butadiene-styrene (SBS) and styrene-isoprene-styrene (SIS), which is the Kraton® D rubber series.

Preferably, the at least one copolymer is at least one triblock copolymer. In particularly preferred embodiments of the present invention the at least one copolymer is at least one triblock copolymer selected from the second generation polymer Kraton® G series. In particular, Kraton® G-1650, which is a two-phase polymer consisting of polystyrene domains in a rubbery poly(ethylene-butylene) matrix, is most preferred.

The Kraton® G series polymers exhibit a high tensile strength and are inherently stable; thus, these copolymers can withstand high processing temperatures and weathering. The Kraton® G series triblock copolymers, in embodiments of the present invention having one or more triblock copolymers, may absorb up to 20 times their weight in oil, resulting in compositions having varying consistencies from extremely gelatinous to a durable elastic rubbery material. Other triblock copolymers exhibiting similar desirable characteristics may be used in accordance with the present invention.

In other embodiments of the present invention, the at least one copolymer that may be used in the present invention includes one or more diblock copolymers. Examples of diblock copolymers that may be useful in forming the compositions of the present invention are commercially available thermoplastic rubber type polymers. Diblock copolymers of the present invention include for example, the AB type such as styrene-ethylenepropylene (S-EP) and styrene-ethylenebutylene (S-EB), styrene-butadiene (SB), and styrene-isoprene (SI). In particular, Kraton® G-1701 and G-1702, which are styrene-ethylenepropylene (S-EP), a polymer consisting of styrene domains in a rubbery poly (ethylene-proplylene) matrix, are preferred.

In yet other embodiments of the present invention, the at least one copolymer may include both diblock and triblock copolymers, as they are described herein independently. Such embodiments may include for example both Kraton® 1650 as a triblock and Kraton® 1652 as a diblock copolymer. Other suitable diblock and/or triblock copolymers would be apparent to those skilled in the art having read the present specification.

In other embodiments of the invention, the at least one copolymer may be a radial block and/or multiblock copolymer. Examples of suitable multiblock and radial block copolymers would be apparent to those skilled in the art based having read the present disclosure.

Other suitable copolymers that may be used in accordance with the present invention, may include copolymers not indicated above, which contain, for example, a styrene-ethylenepropylene (S-EP) polymer consisting of styrene domains in a rubbery poly(ethylene-proplylene) matrix and a two-phase polymer consisting of polystyrene domains in a rubbery poly(ethylene-butylene) matrix. Other examples of copolymers that may be used in accordance with the present invention include those containing two or more of the following segments:

(a) styrene-butadiene-styrene polymers;

(b) styrene-isoprene-styrene polymers;

(c) styrene-ethylene-butylene-styrene polymers;

(d) styrene-ethylenepropylene polymers;

(e) styrene-ethylenebutylene polymers;

(f) styrene-butadiene polymers; and (g) styrene-isoprene polymers.

The total weight of the copolymer(s) within a composition according to the present invention, is preferably about 5% to about 35% by weight of the composition. Within this range, the preferred amount varies depending on whether the composition will be used to form a free standing candle or a container candle. For forming a free standing candle, preferably the total weight of the copolymer(s) in the composition is about 5% to about 25% by weight, more preferably about 9% to about 15% by weight, and most preferably about 15% by weight. For forming a container candle, preferably the total weight of the copolymer(s) in the composition is about 5% to about 15% by weight, more preferably about 5% to about 10% by weight, and most preferably about 7.5% by weight.

The desired combination of characteristics sought for the transparent compositions of the present invention is achieved by including one or more derivatives of an N-acyl amino acid in the composition. N-acyl amino acid derivatives have not previously been used in candle formulations. The use of such derivatives in combination with at least one copolymer unexpectedly provides compositions that meet the stringent requirements of candles and further have additional unexpected desired qualities, such as being able to be formulated into free-standing candles and/or into container candles that do not shift within the container.

The N-acyl amino acid derivatives, which may be used according to the present invention, include for example, N-acyl amino acid amides and N-acyl amino acid esters prepared from glutamic acid, lysine, glutamine, aspartic acid and mixtures thereof.

Non-limiting examples of N-acyl amino acid derivatives that may be used according to the present invention include N-lauroyl-glutamic acid diethyl amide, N-lauroyl-glutamic acid dibutyl amide, N-lauroyl-glutamic acid dihexyl amide, N-lauroyl-glutamic acid dioctyl amide, N-lauroyl-glutamic acid didecyl amide, N-lauroyl-glutamic acid didodecyl amide, N-lauroyl-glutamic acid ditetradecyl amide, N-lauroyl-glutamic acid dihexadecyl amide, N-lauroyl-glutamic acid distearyl amide, N-stearoyl-glutamic acid dibutyl amide, N-stearoyl-glutamic acid dihexyl amide, N-stearoyl-glutamic acid diheptyl amide, N-stearoyl-glutamic acid dioctyl amide, N-stearoyl-glutamic acid didecyl amide, N-stearoyl-glutamic acid didodecyl amide, N-stearoyl-glutamic acid ditetradecyl amide, N-stearoyl-glutamic acid dihexadecyl amide, N-stearoyl-glutamic acid distearyl amide and mixtures thereof. The most preferred N-acyl amino acid for use in the present invention is N-lauroyl-glutamic acid di-n-butylamide (referred to herein as "GP-1"), which is commercially available as Ajinomoto GP-1, from Ajinomoto Co., Inc. of Tokyo, Japan. N-lauroyl-glutamic acid di-n-butylamide, from any source, whether named GP-1 or otherwise is similarly preferred in the present invention.

The at least one N-acyl amino acid derivative in the compositions of the present invention, is present in an amount of about 0.05% to about 2% by weight of the composition. Within this range, the preferred amount varies depending on whether the composition will be used to form a free standing candle or a container candle. For forming a free standing candle, preferably the amount of N-acyl amino acid derivative is about 0.1% to about 2% by weight, and more preferably about 0.3% to about 0.5% by weight. For forming a container candle, preferably the amount of N-acyl amino acid derivative is about 0.05% to about 0.5% by weight, and more preferably about 0.1% to about 0.3% by weight.

Preferably, each of the at least one copolymer and the at least one derivative of N-acyl amino acid are soluble in the liquid base material at elevated temperatures, and at room temperature, e.g., after cooling in the methods described herein.

Preferably, the at least one copolymer and the at least one derivative of N-acyl amino acid are selected in kind and amount so as to assist in reducing the evaporation rate of any volatile components in the composition to which they are added, as well as helping to promote formation of the liquid pool around the wick.

In a particularly preferred embodiment of the present invention, the compositions include a hydrocarbon oil, preferably mineral oil, even more preferably hydrogenated mineral oil, as the liquid base material; in combination with a triblock copolymer and GP-1. Most preferably the triblock copolymer is Kraton®G 1650. Such compositions provide a particularly advantageous combination of performance characteristics.

Preferably, compositions of the present invention are substantially transparent, that is they have a high degree of clarity, with little or no cloudiness or haze, even when fragrances or coloring agents have been added. Preferably, the kind and amount of the ingredients of the present compositions are selected such that the compositions contain one or more of the following characteristics: they do not darken or smoke when a candle made of the composition is burning; they are rigid enough to form a free-standing candle; and/or they are thermoreversible, such that the pool solidifies after a candle made therefrom is extinguished, without significant change to the properties of the composition. Preferably, the ingredients of the compositions are selected in kind and amount such that candles made from the compositions contain one or more of the following characteristics: they do not crack or split during burning or suffer from syneresis; they have a wide pool, which provides a greater fragrance throw and helps avoid tunneling; they do not have an undesirable gelatinous or oily feel to the touch; and they retain structural integrity while burning.

The compositions of the present invention may optionally contain one or more additives, which include, but are not limited to fragrances, coloring agents, decorative materials, insect repellants, solvents, stabilizers, antioxidants, and UV blockers. Non-limiting examples of suitable additives are set forth below. Other suitable additives that may be suitable for use in the present invention may be apparent to those skilled in the art based on this disclosure, and are therefore intended to be encompassed herein.

In a preferred embodiment, compositions of the present invention may be used as a fragrance carrier for dispersing selected fragrances, such as fragrances having a pleasant odor, or fragrances that repel insects. Non-limiting examples of fragrances that may be added to the compositions of the present invention include Citronella, Sweet Peach, Mountain Berry, Country Garden, Lavender Meadows, Strawberries 'N Cream and Vanilla, from Noville Corp., South Hackensack, N.J. Other suitable fragrances that may be added to the compositions of the present invention, would be apparent to those skilled in the art. Fragrances are typically added in an amount of about 0% to about 5% by weight of the total composition, and preferably in an amount of about 2.5% by weight. The weight percent of the optional fragrance may be selected so as to achieve a desired throwing power.

Previously described transparent compositions for dispersing a fragrance, either from the heated reservoir of a tart candle or from a burning candle, typically include materials that, exhibit disadvantages, particularly when they have a high throwing power for dispensing the desired fragrance. In particular, such compositions typically include materials that are both volatile and highly flammable, such that the fumes from such compositions can cause the compositions to auto-ignite.

The transparent compositions of the present invention may also contain one or more coloring agents, which preferably produce a desired color appearance. Preferably the coloring agent is a liquid dye. However, powder and other forms of dyes may also be used. Compositions containing one or more coloring agents preferably remain essentially transparent, much like a transparent colored gemstone such as a ruby or emerald.

The transparent compositions of the present invention may also contain one or more decorative materials, which preferably produce a desired aesthetic appearance. Non-limiting examples of types of decorative materials that may be added to the compositions of the present invention include glitter, sparkles, ribbons, small paraffin ornamental characters, and the like.

The transparent compositions of the present invention may be used as a carrier for dispersing insect repellants. Non-limiting examples of suitable insect repellants include citronella, dimethyl thalate and n,n-dimethyl-m-tolumide.

The transparent compositions of the present invention may also contain one or more solvents. Suitable solvents include solvents known by those skilled in the art that provide for a suitable burn and provide for a good mold release.

The transparent compositions of the present invention may also contain one or more stabilizers. Suitable stabilizers include those known by those skilled in the art that would minimize slumping or creeping in container candles, provide increased tensile strength in pillar candles and/or provide a better fragrance release and prevent degradation of fragrance as the candle bums or during processing.

The transparent compositions of the present invention may also contain one or more antioxidants. An example of a preferred anti-oxidant is BHT, which may be added to compositions of the present invention, for example, in an amount of about 0.01% to about 0.1% by weight of the total composition. Other antioxidants are known to those skilled in the art.

The transparent compositions of the present invention may also contain one or more UV blockers. Preferred UV blockers are benzophenone and/or benzotriazole. Other non-limiting examples of suitable UV blockers include benzophenone and benzotrazole.

The present invention is also directed to candles formed from the compositions described herein and further containing at least one wick. Thus, the candles of the present invention include a liquid base material that is preferably hydrocarbon oil; at least one copolymer, which includes diblock an/or triblock copolymers; at least one derivative of an N-acyl amino acid; and at least one wick. With the exception of the wick(s), the ingredients of the transparent candles of the present invention (such as, the liquid base material, copolymers and derivative of an N-acyl amino acid) are as described above with respect to the compositions of the present invention.

The at least one wick of the candles of the present invention is made from wicking material. The choice of wicking material is important in making an aesthetically acceptable transparent candle. Preferred wicks contain a paper core which have been observed to provide the most desired combination of bum characteristics, especially with respect to attributes such as smoke, bloom, fragrance throw and bum rate. However, other types of suitable wicks known to those in the art, may also be used in accordance with the present invention. Non-limiting examples of suitable wicks and wicking materials known to those skilled in the art are commercially available from Atkins-Pearce of Covington, Ky.

The candles of the present invention may optionally contain one or more additives, such as the additives described above (e.g., fragrances, coloring agents, decorative materials, insect repellants, solvents, stabilizers, antioxidants, and/or UV blockers).

Candles according to the present invention may be free-standing or provided in a container.

Free-standing candles according to the present invention include about 79% to about 91% by weight, and even more preferably about 80% to about 85% by weight of the liquid base material; about 5% to about 25% by weight, more preferably about 9% to about 15% by weight, and most preferably about 15% by weight of the at least one copolymer; and about 0.1% to about 2% by weight, and more preferably about 0.3% to 0.5% by weight of the at least one N-acyl amino acid derivative. Preferred free-standing candles according to the present invention include about 79% to about 85% by weight of hydrogenated mineral oil, about 15% by weight of Kraton®G650, and about 0.3% to 0.5% by weight of GP-1.

Container candles according to the present invention include about 80% to about 95% by weight, and even more preferably about 90% to about 95% by weight of the liquid base material; 5% to about 15% by weight, more preferably about 5% to about 10% by weight, and most preferably about 7.5% by weight of the copolymer; and about 0.05% to about 0.5% by weight, and more preferably about 0.1% to 0.3% by weight of the at least one N-acyl amino acid derivative. Preferred container candles according to the present invention include about 90% to about 95% by weight of hydrogenated mineral oil, about 7.5% by weight of Kraton®G1650, and about 0.1% by weight of GP-1.

Container candles include candles positioned within a container. Suitable containers for use in such container candles would be known to those skilled in the art in view of the present disclosure.

The present invention further provides methods of making the transparent compositions and candles described herein.

A further embodiment of the present invention is directed to a method for making transparent compositions according to the present invention. The method includes adding a liquid base material, at least one copolymer selected from diblock and triblock copolymers, and at least one derivative of N-acyl amino acid to a mixing vessel to form a mixture and heating the mixture to a temperature sufficient to solubilize the at least one copolymer and at least one derivative of N-acyl amino acid in the liquid base material. The mixture may optionally be stirred while it is being heated. Examples of liquid base materials, copolymers and derivatives of N-acyl amino acids are described above with respect to the compositions of the present invention. The liquid base material is preferably a hydrocarbon oil. The at least one copolymer is preferably a triblock copolymer. The N-acyl amino acid derivative is preferably GP-1.

Suitable mixing vessels for forming compositions according to the present invention would be apparent to those skilled in the art in view of the present disclosure.

The heating includes heating the mixture to a temperature of from 200° F. to about 300° F.

Another embodiment of the present invention is directed to methods of making transparent candles of the present invention. The method varies somewhat depending on whether free-standing or container candles are being made. Accordingly, embodiments describing how to made each, are set forth separately below.

One embodiment of the invention includes a method of making free-standing transparent candles. This embodiment includes adding a liquid base material, at least one copolymer selected from diblock and triblock copolymers, and at least one derivative of N-acyl amino acid to a mixing vessel to form a mixture. The mixture is then heated with stirring to a temperature sufficient to solubilize the at least one copolymer and at least one derivative of N-acyl amino acid in the liquid base material, until a homogeneous mixture is obtained. The mixture is then cooled to about 250° F. before pouring into candle molds. The mixture is then allowed to further cool, preferably for approximately 10 minutes, before inserting at least one appropriate wick. The composition is then allowed to cool until the composition is sufficiently solid such that the mold may be removed without the composition changing shape. The mold is then removed. Suitable molds for use in this embodiment would be known to those skilled in the art in view of the present disclosure.

Another embodiment of the invention includes a method of making free-standing transparent candles. This embodiment includes adding a liquid base material, at least one copolymer selected from diblock and triblock copolymers, and at least one derivative of N-acyl amino acid to a mixing vessel to form a mixture. The mixture is then heated with stirring to a temperature sufficient to solubilize the at least one copolymer and at least one derivative of N-acyl amino acid in the liquid base material, until a homogeneous mixture is obtained. The mixture is then cooled to about 250° F. before pouring into one or more containers. The mixture is then allowed to further cool in the container(s), for preferably approximately 10 minutes before inserting at least one appropriate wick. The composition may then be allowed to cool further to ambient temperature. Suitable containers for use in this embodiment would be known to those skilled in the art in view of the present disclosure.

Examples of liquid base materials, copolymers and derivatives of N-acyl amino acids for use in the above described methods of making transparent candles, are described hereinabove with respect to the compositions of the present invention. The liquid base material is preferably a hydrocarbon oil. The at least one copolymer is preferably a triblock copolymer. The N-acyl amino acid derivative is preferably GP-1.

The present invention will now be described in detail with respect to representative embodiments thereof. The following examples are presented to illustrate the present invention but it is not to be considered as limited thereto.

EXAMPLES OF THE INVENTION

Container and free-standing transparent candles according to the present invention are formed in accordance with the methods described in the examples below, which should be regarded in an illustrative, rather than a restrictive sense.

Example 1

The ingredients shown below were combined and heated to about 270° F. with stirring until a homogeneous mixture of the composition was obtained. The mixture was then cooled to about 220° F. before pouring into glass candle container. The composition was then allowed to cool for approximately 10 minutes before inserting an appropriate wick and the composition was allowed to cool even further for about 20 minutes to form a container candle.

| | |
|---|---|
| Hydrogenated mineral oil | 92.4 |
| Kraton ®G1650 | 7.5 |
| GP-1 | 0.10 |

Example 2

The below ingredients were combined and heated to about 280° F. with stirring until a homogeneous mixture of the composition was obtained. The mixtures were then cooled to about 250° F. before pouring into glass candle molds. The composition was allowed to cool for approximately 20 minutes before inserting an appropriate wick. The composition was then allowed to cool further for about 15 minutes until the composition was sufficiently solid as to remove the mold without the composition changing shape. The mold was then removed from the resulting free-standing candles. The ingredients of the composition were as follows:

| | |
|---|---|
| Hydrogenated mineral oil | 84.7 |
| Kraton ®G 1650 | 15.0 |
| GP-1 | 0.3 |

This formulation was used to make free-standing candles, having exceptional tensile strength.

Example 3

The below ingredients were combined and heated to about 280° F. with stirring until a homogeneous mixture of the composition was obtained. The mixtures were then cooled to about 250° F. before pouring into glass candle molds. The composition was allowed to cool for approximately 20 minutes before inserting an appropriate wick. The composition was then allowed to cool further for about 15 minutes until the composition was sufficiently solid as to remove the mold without the composition changing shape. The mold was removed from the resulting free-standing candles. The ingredients of the composition were as follows:

| | |
|---|---|
| Hydrogenated mineral oil | 82.7 |
| Kraton ®G1650 | 15.0 |
| GP-1 | 0.3 |
| Fragrance | 2.0 |

Example 4

The below ingredients were combined and heated to about 280° F. with stirring until a homogeneous mixture of the composition was obtained. The mixtures were then cooled to about 250° F. before pouring into glass candle molds. The composition was allowed to cool for approximately 20 minutes before inserting an appropriate wick. The composition was then allowed to cool further for about 15 minutes until the composition was sufficiently solid as to remove the mold without the composition changing shape. The mold was removed from the resulting free-standing candles. The ingredients of the composition were as follows:

| | |
|---|---|
| Hydrogenated mineral oil | 82 |
| Kraton ®G1650 | 12 |
| GP-1 | 1 |
| Fragrance | 5 |

Example 5

The below ingredients were combined and heated to about 280° F. with stirring until a homogeneous mixture of the composition was obtained. The mixtures were then cooled to about 250° F. before pouring into glass candle molds. The composition was allowed to cool for approximately 20 minutes before inserting an appropriate wick. The composition was then allowed to cool further for about 15 minutes until the composition was sufficiently solid as to remove the mold without the composition changing shape. The mold was removed from the resulting free-standing candles. The ingredients of the composition were as follows:

| | |
|---|---|
| Hydrogenated mineral oil | 79.25 |
| Kraton ®G1650 | 15 |
| GP-1 | 0.75 |
| Fragrance | 5 |

Example 6

The below ingredients were combined and heated to about 280° F. with stirring until a homogeneous mixture of the composition was obtained. The mixtures were then cooled to about 250° F. before pouring into glass candle molds. The composition was allowed to cool for approximately 20 minutes before inserting an appropriate wick. The composition was then allowed to cool further for about 15 minutes until the composition was sufficiently solid as to remove the mold without the composition changing shape. The mold was removed from the resulting free-standing candles. The ingredients of the composition were as follows:

| | |
|---|---|
| Hydrogenated mineral oil | 84.5 |
| Kraton ®G1650 | 10 |
| GP-1 | 0.5 |
| Fragrance | 5 |

What is claimed is:

1. A transparent candle composition comprising:

a liquid base material comprising a hydrocarbon oil;

at least one copolymer selected from the group consisting of diblock, triblock, radial block and multiblock copolymers; and at least one derivative of an N-acyl amino acid; wherein the candle is a transparent free-standing candle or a transparent container candle that does not shift within the container.

2. The composition of claim 1, wherein the hydrocarbon oil is hydrogenated mineral oil.

3. The composition of claim 1, wherein the liquid base material comprises about 65% to about 95% by weight of the composition.

4. The composition of claim 1, wherein the liquid base material comprises about 79% to about 95% by weight of the composition.

5. The composition of claim 1, wherein the liquid base material comprises about 79% to about 91% by weight of the composition.

6. The composition of claim 1, wherein the liquid base material comprises about 90% by weight of the composition.

7. The composition of claim 1, wherein the at least one copolymer comprises a triblock copolymer.

8. The composition of claim 1, wherein the at least one copolymer consists essentially of a triblock copolymer.

9. The composition of claim 1, wherein the at least one copolymer comprises a diblock copolymer.

10. The composition of claim 1, wherein the at least one copolymer comprises a diblock copolymer and a triblock copolymer.

11. The composition of claim 1, wherein the total weight of the at least one copolymer is about 5% to about 35% by weight of the composition.

12. The composition of claim 1, wherein the total weight of the at least one copolymer is about 5% to about 25% by weight of the composition.

13. The composition of claim 1, wherein the total weight of the at least one copolymer is about 9% to about 15% by weight of the composition.

14. The composition of claim 1, wherein the total weight of the at least one copolymer is about 5% to about 15% by weight of the composition.

15. The composition of claim 1, wherein the total weight of the at least one copolymer is about 5% to about 10% by weight of the composition.

16. The composition of claim 1, wherein the derivative of an N-acyl amino acid is N-lauroyl-glutamic acid di-n-butylamide.

17. The composition of claim 1, wherein the total weight of the derivative of an N-acyl amino acid is about 0.05% to about 2% by weight of the composition.

18. The composition of claim 1, wherein the total weight of the derivative of an N-acyl amino acid is about 0.1% to about 2% by weight of the composition.

19. The composition of claim 1, wherein said composition further comprises at least one fragrance.

20. The composition of claim 1, wherein said composition further comprises at least one coloring agent.

21. The composition of claim 1, wherein said composition further comprises at least one decorative material.

22. The composition of claim 1, wherein said composition further comprises at least one insect repellant.

23. The composition of claim 1, wherein said composition further comprises at least one solvent.

24. The composition of claim 1, wherein said composition further comprises at least one stabilizer.

25. The composition of claim 1, wherein said composition further comprises at least one antioxidant.

26. The composition of claim 1, wherein said composition further comprises at least one UV blocker.

27. The composition of claim 1, comprising:

about 79% to about 91% by weight hydrocarbon oil;

about 9% to about 15% by weight triblock copolymer; and about 0.1% to about 2% by weight derivative of an N-acyl amino acid.

28. The composition of claim 1, comprising:

about 79% to about 95% by weight hydrocarbon oil;

about 5% to about 15% by weight triblock copolymer; and about 0.05% to about 0.5% by weight derivative of an N-acyl amino acid.

29. The composition of claim 1, wherein said composition comprises:

about 92.4% by weight of hydrocarbon oil;

about 7.5% by weight of a triblock copolymer; and about 0.1% by weight of N-Lauroyl glutamic acid di-n-butylamide.

30. The composition of claim 1, wherein said composition comprises:

about 84.7% by weight of hydrocarbon oil;

about 15% by weight of a triblock copolymer; and about 0.3% by weight of N-Lauroyl glutamic acid di-n-butylamide.

31. The composition of claim 1, wherein said composition comprises:

about 82.7% by weight of hydrocarbon oil;

about 15% by weight of a triblock copolymer;

about 0.3% by weight of N-Lauroyl glutamic acid di-n-butylamide; and about 2% by weight of a fragrance.

32. The composition of claim 1, wherein said composition comprises:

about 82% by weight of hydrocarbon oil;

about 12% by weight of a triblock copolymer;

about 1% by weight of N-Lauroyl glutamic acid di-n-butylamide; and about 5% by weight of a fragrance.

33. The composition of claim 1, wherein said composition comprises:

about 79.25% by weight of hydrocarbon oil;

about 15% by weight of a triblock copolymer;

about 0.75% by weight of N-Lauroyl glutamic acid di-n-butylamide; and about 5% by weight of a fragrance.

34. The composition of claim 1, wherein said composition comprises:

about 84.5% by weight of hydrocarbon oil;

about 10% by weight of a triblock copolymer;

about 0.5% by weight of N-Lauroyl glutamic acid di-n-butylamide; and about 5% by weight of a fragrance.

35. A transparent candle comprising the composition of claim 1 and at least one wick.

36. The candle of claim 35, further comprising at least one additive selected from the group consisting of fragrances, coloring agents, decorative materials, insect repellants, solvents, stabilizers, antioxidants, and UV blockers.

37. A transparent candle comprising the composition of claim 27 and at least one wick.

38. A transparent candle comprising the composition of claim 28 and at least one wick.

39. A method of making a transparent candle composition comprising:

adding a liquid base material, at least one copolymer selected from the group consisting of diblock, triblock, radial block and multiblock copolymers, and at least one derivative of N-acyl amino acid to a mixing vessel to form a mixture, wherein the liquid base material comprises a hydrocarbon oil; and heating the mixture to a temperature sufficient to solubilize the at least one copolymer and at least one derivative of N-acyl amino acid in the liquid base material, to form a transparent free-standing candle or a transparent container candle that does not shift within the container.

40. The method of claim 39, wherein said method further comprises adding at least one additive selected from the group consisting of fragrances, coloring agents, decorative materials, insect repellants, solvents, stabilizers, antioxidants, and UV blockers, to said mixing vessel prior to heating the mixture.

41. A method of making a transparent free-standing candle, comprising:

adding a liquid base material, at least one copolymer selected from the group consisting of diblock, triblock, radial block and multiblock copolymers, and at least one derivative of N-acyl amino acid to a mixing vessel to form a mixture, wherein the liquid base material comprises a hydrocarbon oil;

heating the mixture to a temperature sufficient to solubilize the at least one copolymer and at least one derivative of N-acyl amino acid in the liquid base material to form a composition;

cooling the composition to about 250° F.;

pouring the transparent composition into a mold;

adding at least one wick;

allowing the composition to cool until it is sufficiently solid to remove the mold without the composition changing shape; and removing said mold, to produce a transparent free-standing candle.

42. The method of claim 41, wherein said method further comprises adding at least one additive selected from the group consisting of fragrances, coloring agents, decorative materials, insect repellants, solvents, stabilizers, antioxidants, and UV blockers, to said mixing vessel prior to heating the mixture.

43. A method of making a transparent container candle, comprising:

adding a liquid base material, at least one copolymer selected from the group consisting of diblock and triblock copolymers, and at least one derivative of N-acyl amino acid to a mixing vessel to form a mixture, wherein the liquid base material comprises a hydrocarbon oil;

heating the mixture to a temperature sufficient to solubilize the at least one copolymer and at least one derivative of N-acyl acid in the liquid base material to form a transparent composition;

cooling the composition to about 250° F.;

pouring the transparent composition into a container;

adding at least one wick;

allowing the composition to cool to ambient temperature, to form a transparent container candle that does not shift within the container.

44. The method of claim 43, wherein said method further comprises adding at least one additive selected from the group consisting of fragrances, coloring agents, decorative materials, insect repellants, solvents, stabilizers, antioxidants, and UV blockers, to said mixing vessel prior to heating the mixture.

* * * * *

UNITED STATES PATENT AND TRADEMARK OFFICE

CERTIFICATE OF CORRECTION

PATENT NO. : 6,478,830 B2
DATED : November 12, 2002
INVENTOR(S) : Gerald Allison et al.

It is certified that error appears in the above-identified patent and that said Letters Patent is hereby corrected as shown below:

Column 8,
Line 58, change “bums” to -- burns --;

Column 9,
Lines 20 and 22, change “bum” to -- burn --.

Signed and Sealed this

Ninth Day of September, 2003

JAMES E. ROGAN
*Director of the United States Patent and Trademark Office*